US005259802A

United States Patent [19]

Yang

[11] Patent Number: 5,259,802

[45] Date of Patent: Nov. 9, 1993

[54] COMPONENT FRISBEE

[76] Inventor: Ming-Tung Yang, No. 4-3, Lane 97, Cung Chuan St., Panchiao, Taipei Hsien, Taiwan

[21] Appl. No.: 929,598

[22] Filed: Aug. 17, 1992

[51] Int. Cl.[5] ..... A63H 27/127

[52] U.S. Cl. ..... 446/48; 446/37; 446/44

[58] Field of Search ..... 446/34, 36, 37, 38, 446/39, 44, 46, 48, 57

[56] References Cited

U.S. PATENT DOCUMENTS 3,229,413 1/1966 Bross ..... 446/39
4,084,345 6/1977 Tanaka ..... 446/44
4,288,942 8/1979 Nicholl ..... 446/48
5,080,624 1/1992 Brinker ..... 446/48

*Primary Examiner*—Robert A. Hafer
*Assistant Examiner*—Gregory M. Stone
*Attorney, Agent, or Firm*—Bacon & Thomas

[57] ABSTRACT

A multi-disc flying device is disclosed in which outer and middle discs rotate in opposite directions by a force generated by the unwinding of a torsion spring. Downwardly extending deflecting plates on each disc generate an upward force during rotation to prolong the flight of the device. An inner disc rotatably attached to the middle disc has a normally curved rudder assembly to impart a curved flight path to the device so that it will return to its launching point. A propeller is driven by relative movement between the rudder and the inner disc to provide a propulsive force to the flying device.

6 Claims, 5 Drawing Sheets

COMPONENT FRISBEE

BACKGROUND OF THE INVENTION

There are frisbees of many types in the market among which are those made of soft safety material, others have whistles, "bouquet" that explodes in the center when being thrown, IC circuits to flash and produce sounds, as well as those having boomerang characteristics to produce circulating flight. Although different types of frisbees provide different kinds of pleasure, they contain, however some common disadvantages: to save strength, there must be at least two experienced players to control the flight of frisbee. Even those that are single player types, an inexperienced player is still not skillful enough to control the flight. Those equipped with all sorts of accessories will burden the flight. Moreover, if the player cannot throw a frisbee at a certain angle and with appropriate force, the frisbee will not return to the player, who then will have to chase after it in order to retrieve it. In short, all conventional frisbees need experienced players in order to save strength and maximize its entertainment value. Should it become a burden to inexperienced players looking for fun they will stop enjoying the joy of frisbee. This limits the function of frisbee games for the old and the young.

SUMMARY OF THE INVENTION

A component frisbee according to the invention is a frisbee that dashes off, flies in the air and returns by itself after being thrown out. It has three correspondingly sized saucer-shaped discs namely an outer, a middle and an inner disk among which the surfaces of the outer and middle discs are formed with downward plates to enhance lift and an arc shaped soft rudder to control the flight path. A spoiler and a pin are located on the inner disc to control a propeller device so that the frisbee can provide all the above-mentioned functions without the need of any skill.

DETAILED DESCRIPTION OF THE PREFERRED EMBODIMENT

Figure 1:
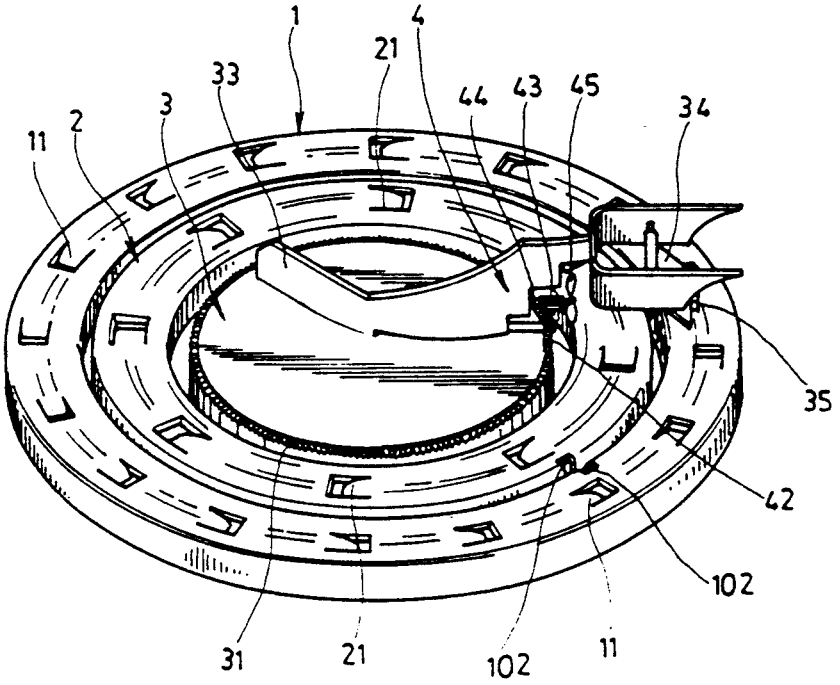
FIG. 1 is a perspective view of the component frisbee according to the invention.
Figure 2:
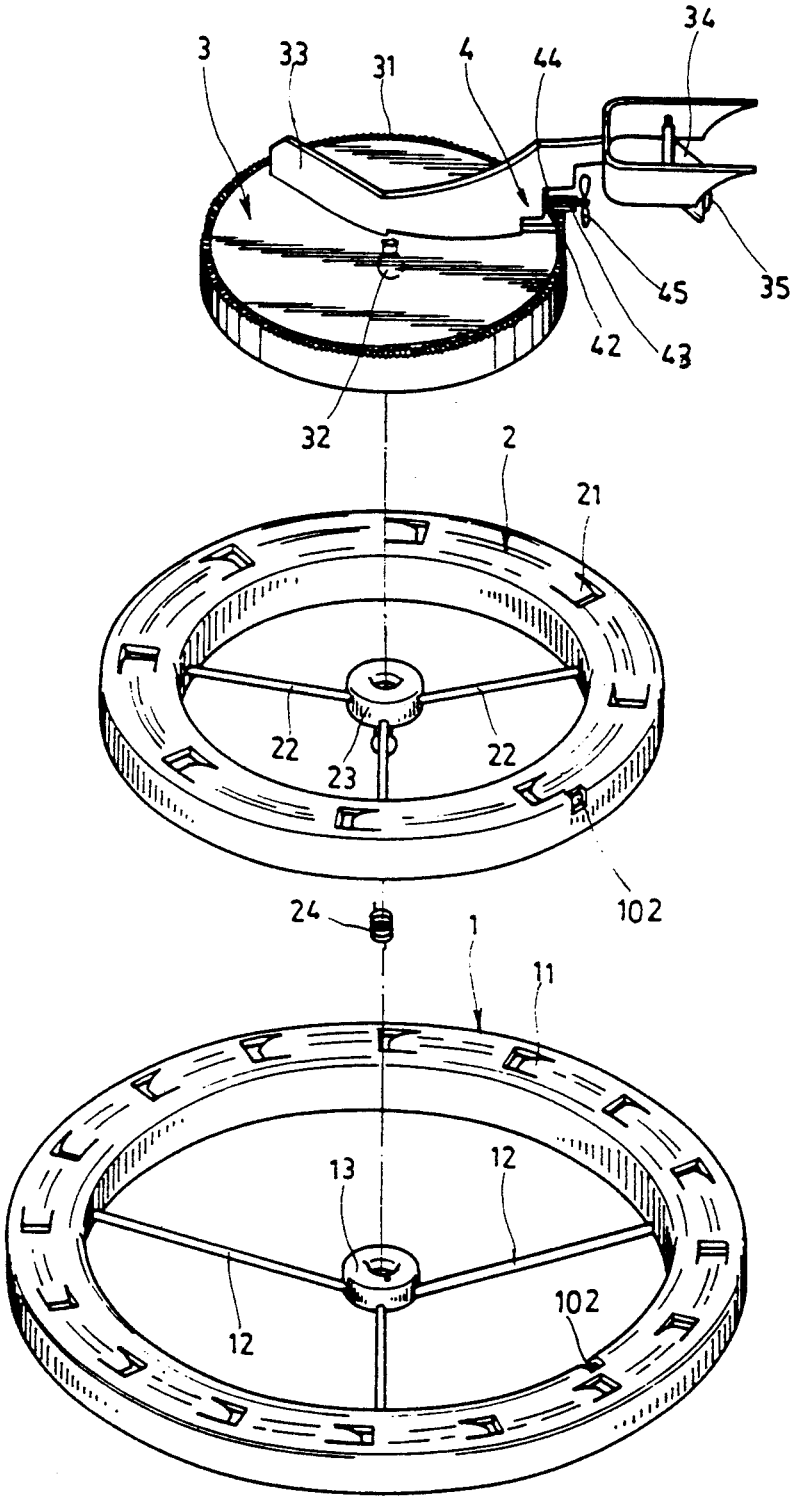
FIG. 2 is an exploded perspective view of the frisbee according to the invention.
Figure 3:
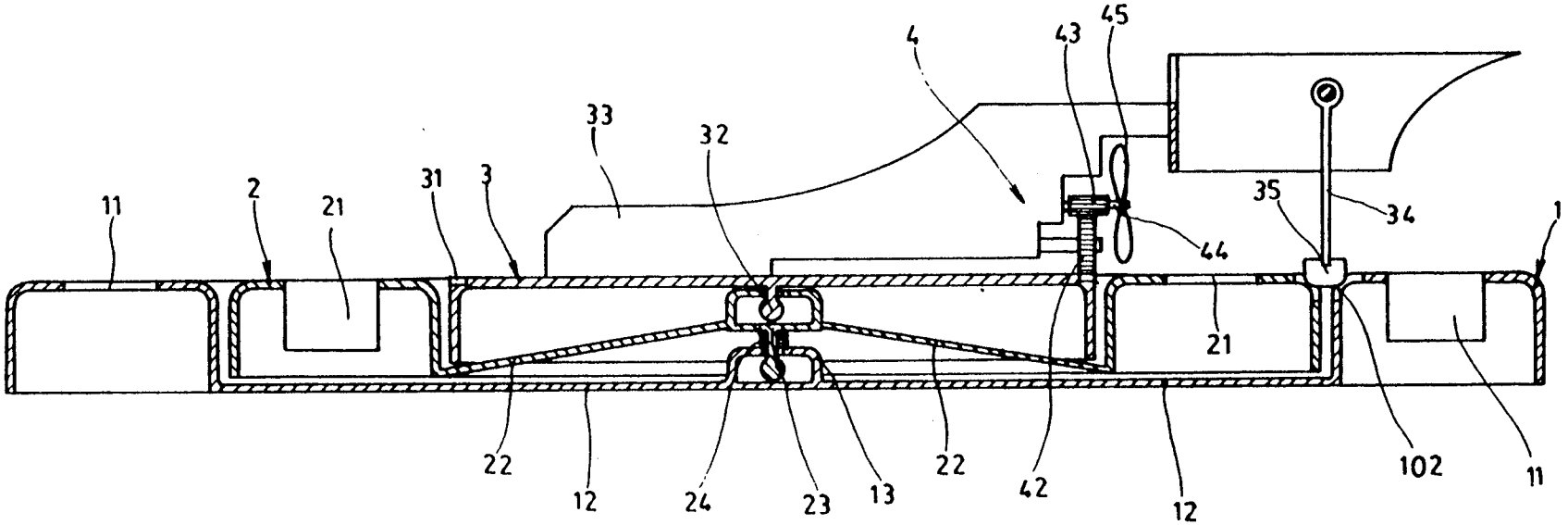
FIG. 3 is a cross sectional view of the frisbee according to the invention.
Figure 4:
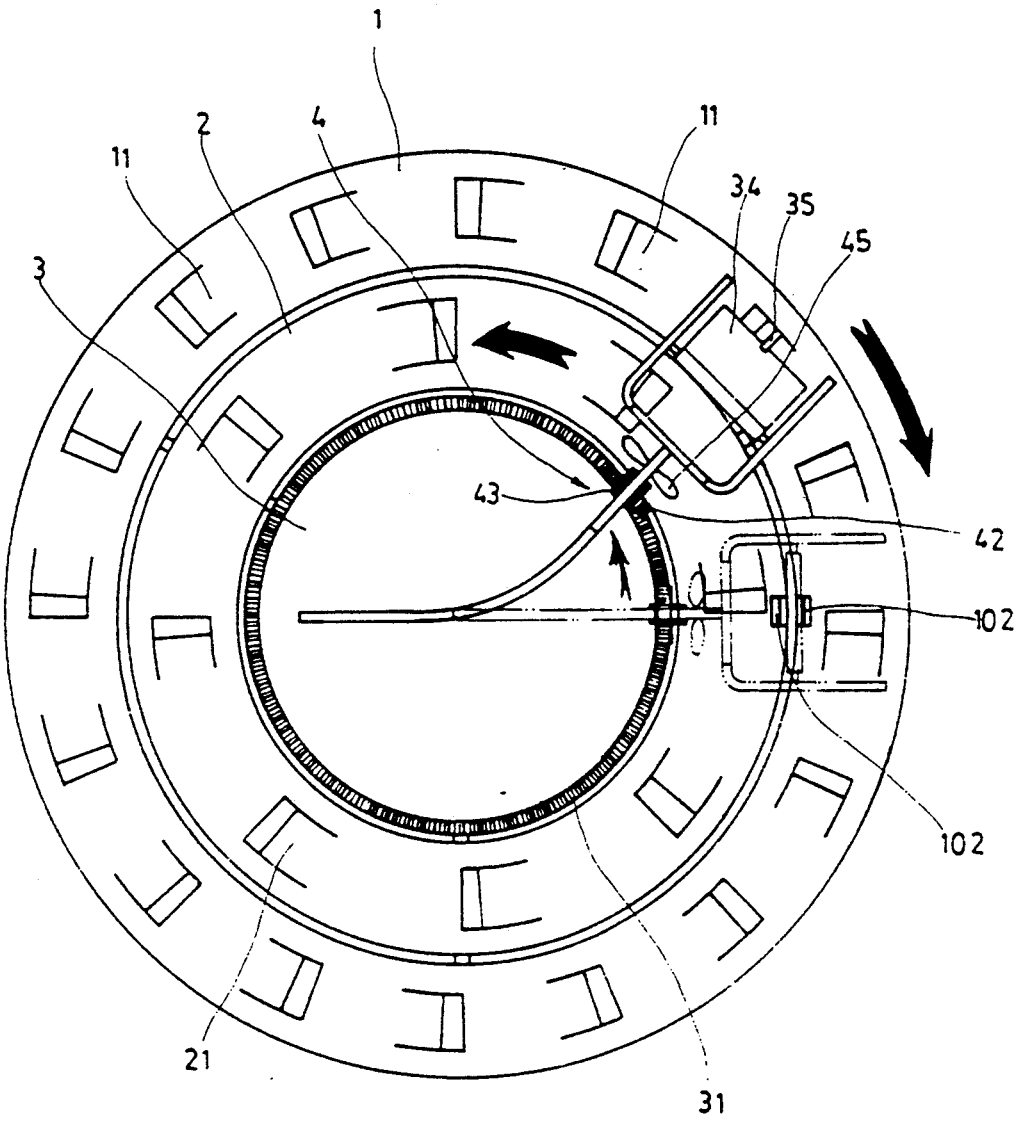
FIG. 4 is a top plan view illustrating the functioning of the invention after being thrown.
Figure 5:
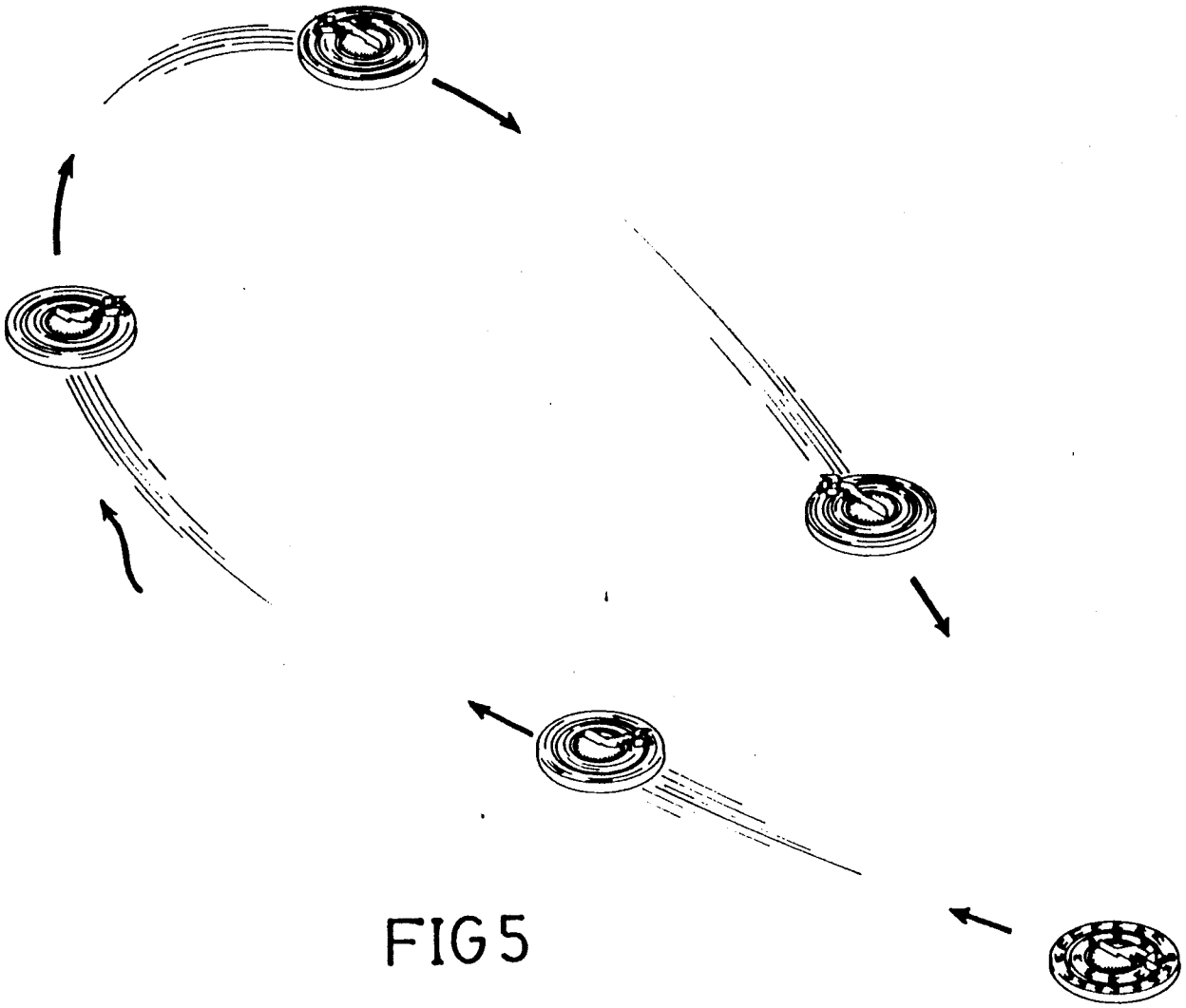
FIG. 5 is a perspective view illustrating the routine of the flight of the invention.

Referring to FIGS. 1 and 2, the invention is a component frisbee that consists of an outer disc (1), a middle disc (2), an inner disc (3) and a propeller device (4) which permit the frisbee to dash off, fly in the air and return by itself after being thrown out. The outer disc (1) is an annular-shaped disc having an empty center part at the center of which there is a saddle (13) connected to the disc body by connectors (12) and designed for the connection with the middle disc (2). The surface of the outer disc is formed with an even number of downward deflecting plates (11) at an appropriate angle so that it produces rising force when the outer disc rotates in the air. The middle disc (2) is an annular-shaped disc sized to fit in the empty center part of the outer disc (1) and is also formed with an even number of downward deflecting plates (21) at an appropriate angle so that it also produces rising forces when rotating in the air. The center of the empty center part of the middle disc (2) also contains a saddle (23) connected to the disc body by connectors (22) so that it can be pressed in the saddle (13) of the outer disc (1) and be connected from the top with the inner disc (3). A torsional spring (24) is located between the bottom of saddle (23) and the saddle (13) to provide a rotation force to the discs to keep the discs in rotation within the elasticity limits of the spring. Corresponding hollow grooves (102) are formed at the outer edge of the middle disc (2) and the inner edge of the outer disc (1) which combined form a groove which, by inserting a pin therein, will block the relative rotation of the outer and middle discs (1) and (2). The inner disc (3) is a circular-shaped disc sized to fit within the empty center part of the middle disc (2). A cog tooth portion (31) is formed on an upper part of the outer edge of the inner disc (3). At the bottom there is pin (32) adapted to be inserted into the saddle (23) in the center of middle disc (2) to enable relative rotation between these elements. An arc-shaped soft rudder (33) at an appropriate angle is located on top of the inner disc (3) so that the frisbee flies and returns in a prescribed orbit. At a notched edge of the tail of the rudder (33) located over the grooves (102) of the middle disc (2) and the outer disc (1), there is a movable spoiler (34) from beneath which extends a pin (35) to be pressed into the grooves (102) so as to block the rotation of the outer disc (1) and middle disc (2) when the spoiler (34) is folded downward. The propeller device (4) makes use of the rotation of the propeller to produce air flow for a propulsion force. At a lower edge of rudder (33) adjacent to the cog-teeth (31), a rotatable gear (42) is installed to mesh with the cog-teeth (31) and to mesh with pinion (43) to turn axle (44) connected to the propeller (45) to turn the propeller to produce air flow to force the device to move forward. The device is a self-sufficient device that enables the frisbee to dash of, fly in the air and return on its own. To use the device, the outer disc (1), middle disc (2) and inner disc (3) are assembled according to the order shown in FIG. 3 to keep the three discs relatively movable. The outer disc (1) and the middle disc (2) are controlled by torsional spring (24) to produce a rotational force. Rudder (33) and propeller device (4) are equipped on the inner disc (3). To play with the component frisbee device, a player winds up the torsional spring (24) by turning the outer disc (1) relative to the middle disc (2) and aligns the grooves (102). To keep the normally arc-shaped soft rudder (33) initially straight, the spoiler (34) is bent down so that the pin (35) can be clicked into the aligned grooves (102) to block the reaction force resulting from the action of the wound torsional spring (24). The rotation of the downward plates of the discs will produce air flow which forces the frisbee to raise in the air automatically. Moreover, at the moment when the spoiler (34) is straightened up and the outer disc (1) and the middle disc (2) rotate, the tail of the rudder (33) is unblocked and it returns to its originally curved position by elasticity as shown in FIG. 4. As it returns, the gear (42) included in the propeller device (4) rotates on the cog-teeth (31) and activates the pinion (43) to turn the propeller (45) to produce air flow. As the rudder (33) returns to its originally curved position, the air flowing from the propeller will change the direction of the frisbee in flight so as to return it to its starting point, which enables the frisbee to dash off, fly in the air and return easily as shown in FIG. 5. The device is a novel and original conception that fits all man who wants to enjoy the joy of frisbee.

From the above description it is clear that the main purpose of the invention is to provide a component frisbee whose compact structure increases the entertainment value of a frisbee that dashes off, flies in the air and returns on its own that is novel and original.

The secondary purpose of the invention is to make use of the component form of the independent structures of the outer, middle and inner discs of which the opposite rotation of the outer and middle discs with downward extending plates produces an air flow force to raise the frisbee in the air without the need of any skill.

The third purpose of the invention is to make use of the arc-shaped soft rudder and propeller device on top of the inner disc actuated by pulling out the spoiler as it is pushed by wind after the frisbee is thrown. The return of the rudder to its arc shape will activate the propeller device to turn the propeller so as to produce an air flow which is transported through the originally curved rudder and forces the frisbee to return.

I claim :

1. A multi-disc, component frisbee flying device comprising:

a) a generally annular outer disc defining an open center;

b) a generally annular middle disc defining an open center;

c) first attachment means attaching the middle disc to the outer disc such that the middle and outer discs may rotate relative to each other wherein the middle disc is located within the open center of the outer disc such that the middle and outer discs are substantially co-planar;

d) an inner disc;

e) second attachment means rotatably the inner disc to the middle disc such that the inner and middle discs may rotate with respect to each other, wherein the inner disc is located within the open center of the middle disc such that the inner and middle discs are substantially co-planar;

f) arc-shaped rudder means operatively associated with the inner disc; and, g) torsion spring means operatively associated with the outer and middle discs so as to cause the outer and middle discs to rotate in opposite directions when the torsion spring means passes from a wound to an unwound condition.

2. The multi-disc flying device of claim 1 wherein the outer disc further comprises a plurality of first generally downwardly extending deflecting plates oriented so as to generate an upward force as the outer disc rotates.

3. The multi-disc flying device of claim 2 wherein the middle disc further comprises a plurality of second generally downwardly extending deflecting plates oriented so as to generate an upward force as the middle disc rotates.

4. The multi-disc flying device of claim 1 wherein the arc-shaped rudder means comprises a rudder made of resilient material having a normally curved, arc-shaped configuration so as to impart a curved flight path to the flying device.

5. The multi-disc flying device of claim 4 further comprising:

a) first and second notches defined, respectively, by the outer and middle discs; and, b) pin means associated with the rudder adapted to be removably inserted into the first and second notches so as to prevent relative rotation of the outer and middle discs.

6. The multi-disc flying device of claim 4 further comprising:

a) cog-teeth formed on the inner disc;

b) a propeller rotatably secured to the rudder; and, c) gear means operatively interposed between the cog teeth and the propeller such that relative movement between the inner disc and the rudder causes the propeller to rotate.

* * * * *